US006843611B2

(12) United States Patent
Blondeel et al.

(10) Patent No.: US 6,843,611 B2
(45) Date of Patent: Jan. 18, 2005

(54) DEVICE FOR PACKAGING AND APPLYING A COSMETIC OR CARE PRODUCT

(75) Inventors: Gilles Blondeel, Villemomble (FR); Marion Prunier, Paris (FR)

(73) Assignee: L'Oreal, Paris (FR)

( * ) Notice: Subject to any disclaimer, the term of this patent is extended or adjusted under 35 U.S.C. 154(b) by 5 days.

(21) Appl. No.: 09/804,740

(22) Filed: Mar. 13, 2001

(65) Prior Publication Data

US 2002/0015611 A1 Feb. 7, 2002

(30) Foreign Application Priority Data

Mar. 16, 2000 (FR) ..... 00 03375

(51) Int. Cl.[7] ..... A45D 40/20
(52) U.S. Cl. ..... 401/88; 401/75; 401/68; 401/87
(58) Field of Search ..... 401/88, 75, 68, 401/76, 77, 55, 69, 49, 87

(56) References Cited

U.S. PATENT DOCUMENTS

| | | | | | |
|---|---|---|---|---|---|
| 3,907,441 | A | * | 9/1975 | Idec et al. | 401/75 |
| 4,166,474 | A | * | 9/1979 | McArdle et al. | 401/75 |
| 5,342,134 | A | | 8/1994 | Lombardi et al. | 401/78 |
| 5,437,513 | A | * | 8/1995 | Favre | 401/68 |
| 5,690,918 | A | * | 11/1997 | Jacks et al. | 424/64 |
| 5,873,667 | A | * | 2/1999 | Inoue et al. | 401/78 |
| 5,895,162 | A | * | 4/1999 | Gueret | 401/118 |
| 5,954,441 | A | | 9/1999 | Welschoff | |
| 5,984,554 | A | | 11/1999 | Bouix | 401/98 |

FOREIGN PATENT DOCUMENTS

| | | |
|---|---|---|
| EP | 0 876777 | 11/1998 |
| EP | 0 981 976 A | 3/2000 |
| FR | 2 765 800 | 1/1999 |
| WO | WO 00/41588 | 7/2000 |

OTHER PUBLICATIONS

Copy of French Search Report of Jan. 25, 2001.

* cited by examiner

*Primary Examiner*—David J. Walczak
(74) *Attorney, Agent, or Firm*—Hunton & Williams LLP

(57) ABSTRACT

A device for packaging and applying a substance constituting a cosmetic or a care product containing at least one volatile hydrocarbon solvent can be closed hermetically and comprises at least two elements, at least one of which is made of a plastics material. The elements are suitable for moving relative to each other in order to enable the substance to be applied. The plastics material is selected in such a manner that the element(s) is/are not subject to significant mass variation when put into prolonged contact with the vapor of said solvent.

36 Claims, 2 Drawing Sheets

DEVICE FOR PACKAGING AND APPLYING A COSMETIC OR CARE PRODUCT

The present invention relates to the field of devices for packaging and applying a substance constituting a cosmetic or care product.

The invention relates more particularly but not exclusively to a device for packaging and applying lipstick.

BACKGROUND OF THE INVENTION

Numerous devices have been proposed for packaging and applying lipstick.

By way of example, reference can be made to French patent applications FR-A-2 548 880 and FR-A-2 762 763, and also to European patent application EP-A-0 815 766 in the name of the Applicant company.

In general, it is desired to close the case hermetically while it is not in use so as to ensure good conservation of the lipstick, and in particular to prevent evaporation of the volatile hydrocarbon solvents contained in the material.

Tests performed in-house have shown that cases presently on the market provide satisfactory sealing, i.e. no change is observed in the weight of a closed case after it has been stored for a long time at a temperature higher than ambient.

In spite of that sealing, it has been found that for certain compositions conservation of the lipstick is not as good as it should be and that the quality of making up suffers as a consequence.

OBJECTS AND SUMMARY OF THE INVENTION

The present invention seeks in particular to improve lipstick conservation.

More generally, the invention seeks to improve the conservation of a substance constituting a cosmetic or care product containing at least one volatile hydrocarbon solvent contained in a hermetically-closable packaging and applicator device comprising at least two elements, at least one of which is made of a plastics material, said elements being suitable for moving relative to each other in order to enable the substance to be applied.

The invention achieves this by the fact that the plastics material is selected in such a manner that said element(s) is/are not subject to significant mass variation when put into prolonged contact with the vapor of said solvent.

The Applicant company has found, surprisingly, that by making the elements of the device that are exposed to the vapors of the volatile hydrocarbon solvents contained in the substance out of one or more such plastics materials, it is possible to improve conservation of the substance.

After making the invention and performing comparative tests in-house, the Applicant company has found that conservation of the substance can be improved by preventing the plastics material components of the device from absorbing any of the solvent vapors, even in tiny quantities.

The Applicant company has also found that when the device includes a mechanism for moving the substance, as applied for example to a lipstick case, the present invention makes it possible to avoid any risk of the dimensions of the plastics material components varying and causing the mechanism to misfunction after absorbing volatile hydrocarbon solvent(s) contained in the substance, in the event of storage taking place at a temperature that is relatively high and/or over a long period (several years). The drive mechanisms of lipstick cases include parts that must be moved accurately relative to one another and they are particularly sensitive to variations in dimensions.

The invention is particularly advantageous when the solvent is selected from hydrocarbon oils having 8 to 16 carbon atoms, or mixtures thereof, with the solvents being selectable from $C_8$–$C_{16}$ branched alkanes and mixtures thereof and can be constituted by isododecane.

Preferably, non-polyolefin plastics materials are used for making the plastics material components of the device.

Thus, it is possible to use materials selected from the following list: styrene compounds, in particular polystyrenes and copolymers thereof (styrene butadiene (SB), styrene-acrylonitrile (SAN), acrylobutadiene-styrene (ABS)), polyvinyl chlorides and derivatives thereof, polyacrylics (polymethyl methacrylate (PMMA)), polyoxymethylenes (POM), polyamides (PA), and saturated thermoplastic polyesters, in particular polyethylene terephthalate (PET).

In an embodiment, all of the plastics material components of the device are made of ABS.

When the device has an outer cover, then the cover is advantageously made of ABS or a copolymer of ABS and SAN.

When the device includes a drive mechanism comprising at least two components that are movable relative to each other, it is advantageous for these components to be made of different materials, one of the components being made of POM and the other component of ABS.

This improves sliding and avoids making creaking noises.

At least one of said plastics material elements that is not subject to significant mass variation can belong to a drive mechanism for the substance.

At least one of said plastics material elements that is not subject to significant to mass variation can be invisible from outside the device.

At least one of said plastics material elements that is not subject to significant mass variation can be in direct contact with the substance.

BRIEF DESCRIPTION OF THE DRAWINGS

Other characteristics and advantages of the present invention will appear on reading the following detailed description of non-limiting embodiments, and on examining the accompanying drawings, in which.

MORE DETAILED DESCRIPTION

Figure 1:
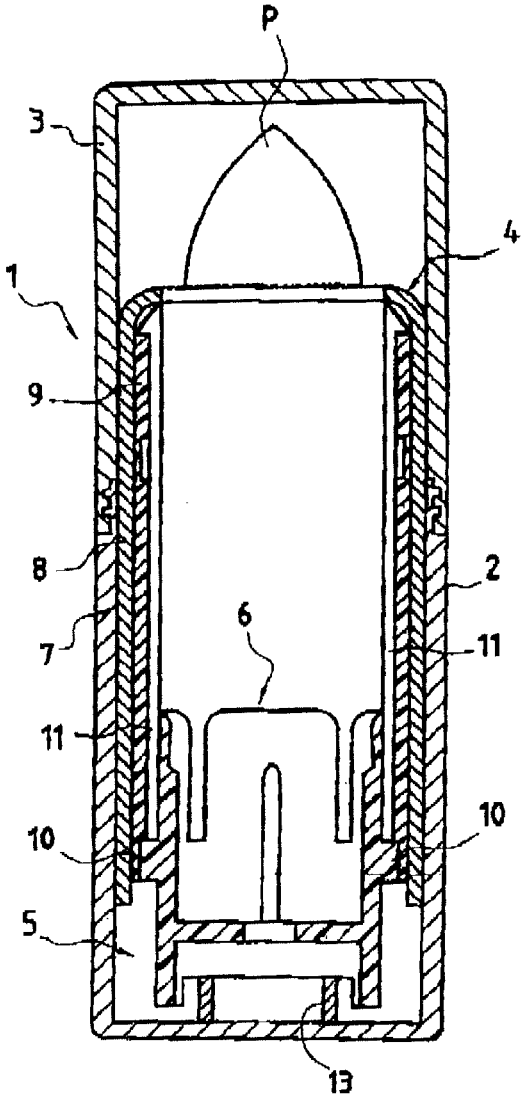
FIG. 1 is a diagrammatic axial section of a first example of a lipstick case.
Figure 2:
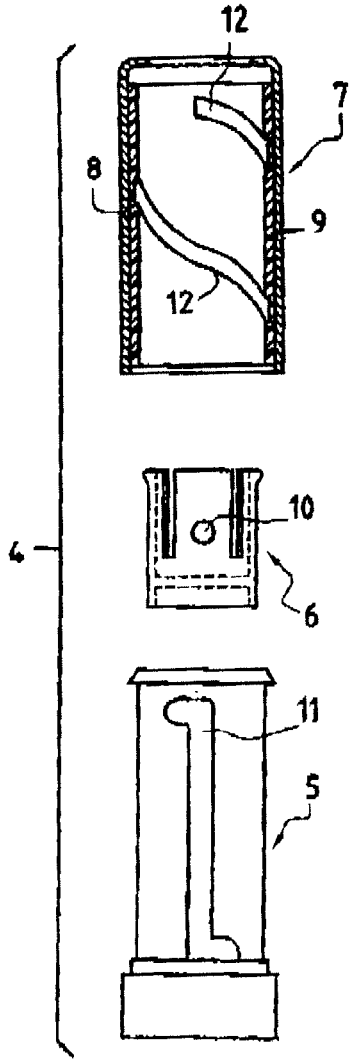
FIG. 2 is an exploded diagrammatic view of the drive mechanism of the FIG. 1 case.

FIGS. 1 and 2 show a case 1 constituting a first embodiment of the invention.

In this example, the case 1 has an outer cover comprising a body or base 2, a removable cap 3, and a drive mechanism 4 to move the stick of substance P in an axial direction.

The mechanism 4 presents a conventional structure and it is constituted by an assembly of three elements, namely a ferrule 5, a stick-carrying cup 6, and a sheath 7.

The ferrule 5 and the cup 6 are made of plastics material and the sheath 7 has a metal sleeve 8 lined with an inner lining 9 of plastics material.

In conventional manner, the cup 6 has two diametrically opposite studs 10 arranged to slide in two diametrically opposite guide slots 11 in the ferrule 5.

The ends of the studs 10 engage in helical grooves 12 in the inner lining 9 such that turning the ferrule 5 relative to the sheath 7 causes the cup 6 to move axially.

The body 2 has a short cylinder 13 that engages in the ferrule 5 and that is constrained to rotate together therewith.

To extend the stick of substance P, the user removes the closure cap 3 and turns the sheath 7 relative to the body 2.

FIG. 1 shows only the top end of the stick of substance P in order to clarify the drawing.

For further details concerning the structure of such a lipstick case, reference can be made to French patent application FR-A-2 248 880.

Figure 3:
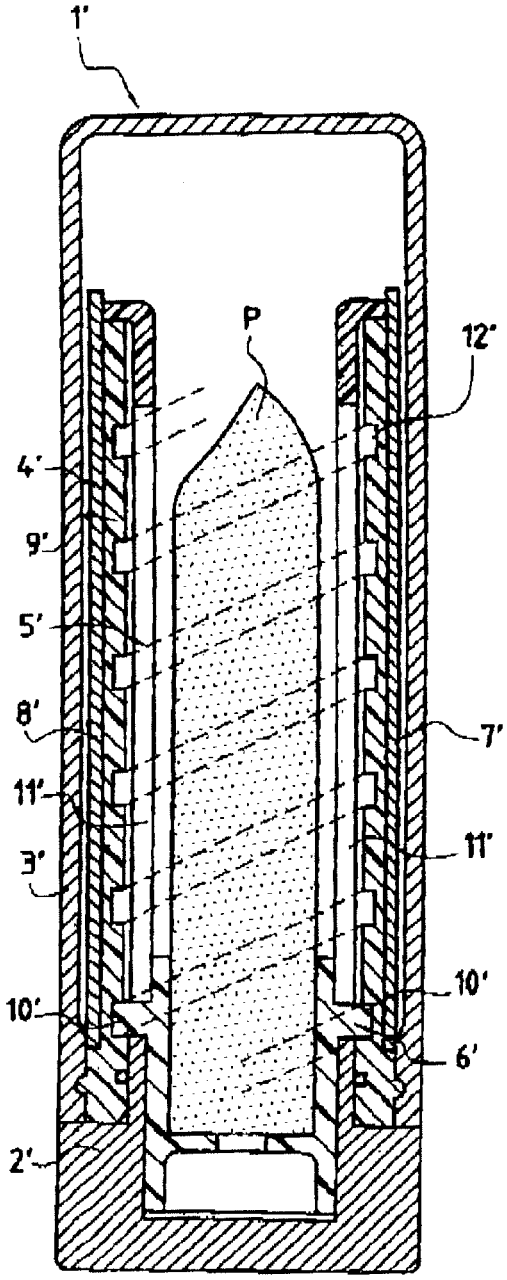
FIG. 3 is a diagrammatic axial section of a second example of a lipstick case.

FIG. 3 shows a lipstick case 1' of known structure as described in French patent application FR-A-2 762 763, to which reference can advantageously be made.

The case 1' has an outer cover comprising a body or base 2' and a closure cap 3', the cap housing a drive mechanism 41 comprising a sheath 7', a ferrule 51, and a stick-carrying cup 6'.

The ferrule 5' is formed integrally with the body 21 and has two diametrically opposite slots 11' in which two diametrically opposite studs 10' of the cup 6' can slide.

The sheath 7' comprises an outer metal sleeve 8' lined by an inner lining 9' fitted with a helical thread 12'.

Operation is similar to that of the case 1.

Figure 4:
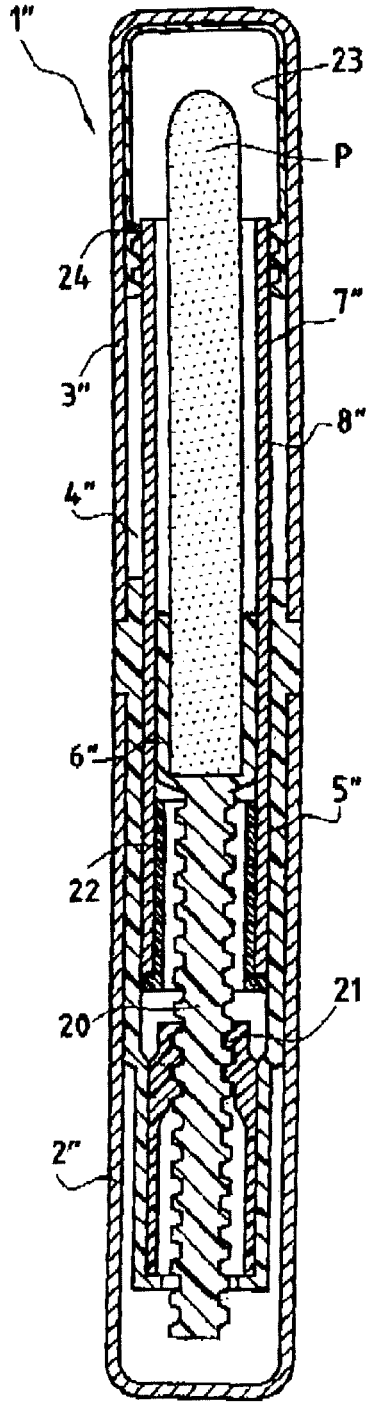
FIG. 4 is a diagrammatic axial section of a third example of a lipstick case.

FIG. 4 shows another case 1".

The structure of this case 1" is described in European patent application EP-A-0 815 666.

The case 1" has an outer cover comprising a body or base 2" and a closure cap 311, the body 2" and the cap 3" being made of metal, for example.

The case 1" has a drive mechanism 4" which comprises a plastics material assembly 5" that is fixed relative to the body 2", a sheath 7" that is free to turn relative thereto, and a stick-carrying cup 6".

The cup 6" is secured to a threaded rod 20 of plastics material engaged in a nut-forming element 21 belonging to the assembly 51".

The sheath 71" includes a metal sleeve 8" that can turn relative to the body 2" but that is prevented from moving in translation, and which has a plastics material insert 22 engaged therein.

Over its length, the threaded rod 20 has two diametrically opposite flats that are not visible in the drawing since they are parallel to the section plane of FIG. 4.

The insert 22 has two drive surfaces (not shown in FIG. 4) which bear against the flats of the rod 20 so that turning the sheath 7" serves to turn the rod 20 which remains free to move axially relative to the insert 22, the threads of the rod 22 engaging in the element 21.

Thus, turning the rod 20 causes the cup 6" to move axially in the sleeve 8".

It will be observed that the closure cap 3" has an insert 23 provided with projections 24.

These projections engage in corresponding grooves in the sleeve 8" when the cap 3" is in place so as to obtain hermetic closure.

In all of the embodiments of the invention described above, the components made of plastics material are made of materials that are selected so as to present no significant mass variation when placed in prolonged contact with vapors of the volatile solvent(s) contained in the substance P.

In the meaning of the present invention, the term "volatile solvent" is used to mean a non-aqueous medium that is liquid at ambient temperature (25° C.) and at normal atmospheric pressure (760 millimeters of mercury (mm of Hg)) and that is suitable for evaporating from the skin or the lips in less than one hour.

Such a solvent can be selected from media having a vapor pressure at ambient temperature and normal atmospheric pressure that lies in the range 10–3 mm of Hg to 300 mm of Hg (0.13 Pascals (Pa) to 40,000 Pa).

In the embodiments described, the solvents under consideration are hydrocarbon oils comprising 8 to 16 atoms of carbon, or mixtures thereof.

Such oils can be selected from $C_8$–$C_{16}$ branched alkanes and mixtures thereof.

For example, $C_8$–$C_{14}$ isoparaffins are used, or indeed isododecane, isohexadecane, or isohexyl neopentanoate, with isododecane being preferred.

As an example of a commercial reference for isododecane, mention can be made of permethyl 99A from Presperse Inc.

In the embodiments described, the substance P contains 5% to 90% volatile solvents, and preferably at least 20%.

By way of example, the substance P can have one of the following compositions:

EXAMPLE 1

| | |
|---|---|
| Isododecane, (2,2,4,6,6) pentanethyl heptane | 20% |
| Phenyltrimethicone | 49% |
| Polyethylene wax (MW 500) | 20% |
| Pigments and pearlescent agents | 11% |
| the proportions above being fractions by weight. | |

The lipstick is made by dispensing the pigments and pearlescent agents in the phenyltrimethicone and then adding the wax and heating to 100° C. until all of the wax has melted. Thereafter the isododecane is added at 80° C. The molten mixture is then poured into a suitable mold to form a stick and then cooled to ambient temperature. The resulting stick is homogeneous, soft, and not fatty. It produces a comfortable film on the lips all day long which does not transfer.

EXAMPLE 2

| | |
|---|---|
| Isododecane | 20% |
| Polyisobutene | 41% |
| Polydimethylsiloxane (100 centistokes (cSt)) | 8% |
| Polyethylene wax (MW 500) | 20% |
| Pigments and pearlescent agents | 11% |

This lipstick is made as in Example 1. A lipstick is obtained which is easy to apply and which, after the isododecane has evaporated, gives rise to a film that is comfortable and that does not transfer.

EXAMPLE 3

| | |
|---|---|
| Isododecane | 35% |
| Polyisobutene | 18% |
| Polydimethylsiloxane (100 cSt) | 8% |
| Polyethylene wax (MW 500) | 16.5% |
| Pigments and pearlescent agents | 11% |
| Arachidyl propionate | 7.5% |

This lipstick is obtained as in Example 1 and it presents the same properties.

EXAMPLE 4

| | |
|---|---|
| Phase A | |
| Hydrogenated polyisobutene | 11% |
| Diglyceryl diisostearate sold under the reference Salacos 42 by Nisshin Oil Mills | 4.86% |
| Copolymer of polyvinylpyrrolidone (PVP) and eicosane | 5% |
| Antioxidizing agent | qsp |
| Phase B | |
| Polyethylene wax (MW 400) | 10% |
| Phase C | |
| Titanium oxide | 0.28% |
| DC red No. 7 | 1.03% |
| FDC yellow No. 6 Al lake | 2.19% |
| Kaolin | 7.50% |
| Phase D | |
| Phenyltrimethicone (1000 cSt) | 35% |
| Phase E | |
| Mica | 1% |
| Phase F | |
| Isododecane | 22.08% |
| By weight: | 100% |

Procedure

The particulate phase C is ground in phase A using a three-cylinder mill. The polyethylene wax is then added and the mixture is heated to 100° C. until the wax has dissolved completely. Thereafter the phenyltrimethicone and the mica are added at 100° C. followed by the isododecane at 80° C.–90° C. The mixture can then be cast at 80° C.–85° C. in suitable molds for obtaining sticks.

In all of the embodiments described above, the substance P contains a non-negligible fraction of isododecane and the plastics material components of the cases 1, 1', and 1" are selected to be made out of non-polyolefin thermoplastic materials.

Thus, instead of using polypropylene or high density polyethylene of the kind commonly encountered in the manufacture of known lipstick cases, it is possible to use styrene compounds for example polystyrenes (PS) and copolymers thereof (SB, SAN, ABS), polyvinyl chlorides and derivatives thereof, polyacrylics (PMMA), polyoxymethylenes (POM), polyamides (PA), and saturated thermoplastic polyesters, in particular polyethylene terephthalate (PET).

Tests performed by the Applicant company have shown that such materials, when exposed during prolonged periods of time to isododecane vapor are not subject to significant mass variation, unlike polyolefins such as polypropylene or high density polyethylene.

Tests have been performed using polystyrene-acrylonitril (SAN) to make the ferrule, the cup, and the inner lining of the cases 1 and 1'.

Those tests revealed mass variation of less than 0.4% after prolonged exposure to isododecane vapor.

A case 1" has also been made with all of its plastics components made of acrylobutadiene-styrene (ABS) and the measurements performed did not reveal any mass variation of the components after prolonged exposure to isododecane vapor.

The invention applies in general to all known lipstick cases.

For cases in which the outer cover includes polypropylene or high density polyethylene, it is advantageous to replace those materials with ABS or with an ABS and SAN copolymer.

The drive mechanism is advantageously made of materials that differ from one another so as to obtain better movement characteristics, in particular better sliding and reduced noise in use.

Thus, to make one of the components of the drive mechanism, it is possible to use a material that is different from that used to make the other components of the mechanism, one of the components being made of POM, for example, while the other components are made of ABS.

The invention has shown that in addition to obtaining better conservation of the substance, the plastics material components of the case have dimensional stability that is guaranteed over a long period, even in the event of storage at a relatively high temperature.

Comparative tests have shown that mechanisms having components made of polyolefin are subject to dimensional variations that can significantly alter the torque that needs to be applied in order to cause the stick-carrying cup to move axially, and which can, in the limit, lead to the mechanism jamming.

The invention also makes it possible to avoid the lipstick drying out due to a loss of solvent, where such drying out can lead to the stick diameter shrinking and to the stick becoming detached from the cup that carries it; in addition, when a stick dries out it becomes harder and that prevents the substance being spread properly on the lips.

Naturally, the invention is not limited to the embodiments described above.

In particular, the invention is not limited to cases where the hydrocarbon solvent contained in the substance is isododecane.

Furthermore, the invention is not limited to lipstick cases but applies in general to any packaging and applicator device in which it is desired to achieve hermetic closure and in which plastics material components are used that are exposed to the vapors of hydrocarbon solvents contained in the substance.

What is claimed is:

1. A device for applying a substance, comprising:

the substance, said substance containing at least one volatile hydrocarbon solvent;

a drive mechanism comprising at least two components that are movable relative to each other to enable the substance to be applied, one of the components being made of POM and the other component of ABS.

2. A device according to claim 1, constituting a lipstick case.

3. A device according to claim 1, wherein the solvent is selected from hydrocarbon oils having 8 to 16 carbon atoms, and mixtures thereof.

4. A device according to claim 3, wherein said solvent is selected from C8–C16 branched alkanes and mixtures thereof.

5. A device according to claim 4, wherein the solvent is isododecane.

6. A device according to claim 1, comprising an outer cover and wherein the cover is made of ABS or a copolymer of ABS and SAN.

7. A device according to claim 1, wherein at least one of said plastics material components is in direct contact with the substance.

8. A device according to claim 1, wherein said substance is one of a cosmetic product and a care product.

9. A device according to claim 1, wherein the drive mechanism comprises a ferrule, a stick-carrying cup and a sheath.

10. A device according to claim 1, wherein the cup has two diametrically opposite studs arranged to slide in two diametrically opposite guide slots in the ferrule.

11. A device according to claim 1, being configured so as to be hermetically closable.

12. A device for applying a substance, comprising:

the substance, said substance comprising at least one volatile hydrocarbon solvent;

a drive mechanism comprising at least two components that are movable relative to each other to enable the substance to be applied, the components being made of non-polyolefin plastics materials.

13. A device according to claim 12, wherein all of the plastics material components of the device are made of acrylobutadiene-styrene (ABS).

14. A device according to claim 12, comprising an outer cover, wherein the cover comprises ABS or a copolymer of ABS and SAN.

15. A device according to claim 12, comprising a drive mechanism comprising at least two components that are movable relative to each other, and wherein these components are made of different materials, one of the components being made of POM and the other component of ABS.

16. A device according to claim 12, wherein at least one of said non-polyolefin plastics material components is not visible from outside the device.

17. A device according to claim 12, wherein at least one of said non-polyolefin plastics material components is in direct contact with the substance.

18. A device according to claim 12, having an outer cover comprising a body, wherein the drive mechanism comprises a plastics material assembly that is fixed relative to the body, a sheath that is free to turn relative thereto and a stick-carrying cup.

19. A device according to claim 18, wherein the cup is secured to a threaded rod of plastics material engaged in a nut-forming element belonging to the assembly.

20. A device according to claim 19, wherein the sheath comprises a metal sleeve that can turn relative to the body but that is prevented from moving in translation.

21. A device according to claim 12, constituting a lipstick case.

22. A device according to claim 12, wherein the solvent is selected from hydrocarbon oils having 8 to 16 carbon atoms, and mixtures thereof.

23. A device according to claim 22, wherein said solvent is selected from one or more $C_8$–$C_{16}$ branched alkanes.

24. A device according to claim 23, wherein the solvent is isododecane.

25. A device according to claim 12, wherein the plastics material components of the device are styrene compounds, polyvinyl chlorides and derivatives thereof, polyacrylics (PMMA), polyoxymethylenes (POM), polyamides (PA), or saturated thermoplastic polyesters.

26. A device according to claim 25, wherein the styrene compounds are polystyrenes or copolymers thereof.

27. A device according to claim 25, wherein the styrene compounds are SB, SAN, or ABS.

28. A device according to claim 25, wherein said saturated thermoplastic polyesters are polyethylene terephthalate (PET).

29. A device according to claim 12, wherein said substance is one of a cosmetic product and a care product.

30. A device according to claim 12, wherein the drive mechanism comprises a ferrule, a stick-carrying cup and a sheath.

31. A device according to claim 30, wherein the ferrule and the cup are made of plastics material.

32. A device according to claim 30, comprising an outer cover having a body, wherein the ferrule is formed integrally with said body.

33. A device according to claim 30, wherein the sheath comprises a metal sleeve lined with an inner lining of plastics material.

34. A device according to claim 33, wherein the cup has two diametrically opposite studs arranged to slide in two diametrically opposite guide slots in the ferrule.

35. A device according to claim 34, wherein each stud has an end engaging in a helical groove in the inner lining such that turning the ferrule relative to sheath causes the cup to move axially.

36. A device according to claim 12, being configured so as to be hermetically closable.

* * * * *

UNITED STATES PATENT AND TRADEMARK OFFICE

CERTIFICATE OF CORRECTION

PATENT NO. : 6,843,611 B2
APPLICATION NO. : 09/804740
DATED : January 18, 2005
INVENTOR(S) : Blondeel et al.

It is certified that error appears in the above-identified patent and that said Letters Patent is hereby corrected as shown below:

On Title Page (56)
Page 1, left column, under "U.S. PATENT DOCUMENTS"

| | | | | |
|---|---|---|---|---|
| Add: -- | 5,888,004 | 3/1999 | Bouix et al. | 401/87 -- |
| -- | 6,116,802 | 9/2000 | Gueret et al. | 401/98 -- |

On Title Page (56)
Page 1, right column, under "FOREIGN PATENT DOCUMENTS"

| | | | |
|---|---|---|---|
| Add: -- | GB | 2 143 212 A | 7/1984 -- |
| -- | JP | 08-117023 | 5/1996 -- |
| -- | JP | 08-117024 | 5/1996 -- |

Signed and Sealed this

Fifth Day of December, 2006

JON W. DUDAS
*Director of the United States Patent and Trademark Office*